US006345747B1

(12) United States Patent
Ogata et al.

(10) Patent No.: US 6,345,747 B1
(45) Date of Patent: Feb. 12, 2002

(54) STRAP ASSEMBLY

(75) Inventors: Hiroki Ogata, Chiba; Yasuhiro Ootori, Kanagawa, both of (JP)

(73) Assignee: Sony Computer Entertainment, Inc., Tokyo (JP)

( * ) Notice: Subject to any disclaimer, the term of this patent is extended or adjusted under 35 U.S.C. 154(b) by 0 days.

(21) Appl. No.: 09/435,228

(22) Filed: Nov. 5, 1999

(30) Foreign Application Priority Data

Nov. 6, 1998 (JP) ..... P10-316444

(51) Int. Cl.[7] ..... A45F 3/14
(52) U.S. Cl. ..... 224/257; 224/267
(58) Field of Search ..... 224/257, 267, 224/220

(56) References Cited

U.S. PATENT DOCUMENTS

| | | | | | |
|---|---|---|---|---|---|
| 3,995,872 | A | * | 12/1976 | Joseph | 280/11.37 H |
| 4,130,293 | A | | 12/1978 | Hinterreiter | |
| 4,252,344 | A | * | 2/1981 | Larsen | 280/822 |
| 4,342,477 | A | * | 8/1982 | McClure | 292/307 R |
| 4,593,933 | A | * | 6/1986 | Nunno | 280/812 |
| 4,993,127 | A | * | 2/1991 | Mechem et al. | 24/701 |
| 5,027,477 | A | | 7/1991 | Seron | |
| 5,039,200 | A | * | 8/1991 | Michler et al. | 359/541 |
| 5,178,311 | A | * | 1/1993 | McBride | 224/191 |
| 5,197,164 | A | * | 3/1993 | Meier | 24/16 PB |
| 5,203,481 | A | * | 4/1993 | Dobbins et al. | 224/148 |
| 5,244,135 | A | | 9/1993 | Nelson | |
| 5,379,928 | A | * | 1/1995 | Mikkelsen | 224/257 |
| 5,398,855 | A | * | 3/1995 | Schaiewitz | 224/257 |
| 5,408,220 | A | * | 4/1995 | Brown et al. | 340/571 |
| 5,420,766 | A | * | 5/1995 | Hollis | 362/96 |
| 5,553,345 | A | * | 9/1996 | Bell | 15/209.1 |
| 5,601,356 | A | * | 2/1997 | McWilliams | 362/103 |
| 5,658,245 | A | * | 8/1997 | McGinnis et al. | 602/32 |
| 5,775,965 | A | * | 7/1998 | Hango | 441/75 |
| 5,893,803 | A | * | 4/1999 | Leadbetter et al. | 473/206 |
| 5,906,233 | A | * | 5/1999 | May | 160/178.1 R |
| 5,941,435 | A | * | 8/1999 | Munro, III | 224/267 |
| 5,947,352 | A | * | 9/1999 | Parsons | 224/250 |
| 6,044,523 | A | * | 4/2000 | Ortega | 16/442 |

FOREIGN PATENT DOCUMENTS

| | | |
|---|---|---|
| DE | 91 03 245 | 6/1991 |
| EP | 0 848 187 A2 | 6/1998 |
| JP | 2-89920 | 7/1990 |
| JP | 08 010030 | 1/1996 |
| JP | 8-112130 | 5/1996 |
| JP | 9-60635 | 3/1997 |
| JP | 30-41856 | 7/1997 |
| JP | 5045108 | 10/1997 |
| JP | 3044568 | 12/1997 |
| JP | 3048035 | 2/1998 |
| JP | 3050214 | 4/1998 |
| JP | 3052469 | 7/1998 |
| JP | 3052586 | 7/1998 |

* cited by examiner

*Primary Examiner*—Stephen P. Garbe
(74) *Attorney, Agent, or Firm*—Rosenman & Colin LLP

(57) ABSTRACT

In a strap assembly for carrying a portable device, in order to protect a user against the action of an unexpected sudden external force, a cord for installing the strap assembly to the portable device is passed through an installation hole of a coupling from the inside such that a knot of a strap is supported by the rim of the installation hole. Coupling holes in both ends of the strap hung from the body of the user are fitted over support posts formed on the inner bases of first and second coupling members. Tapered surfaces are formed on portions of the cylindrical side surfaces of support posts. When the first and second coupling members are closed together with their rims superposed, protrusions of one member engage recesses of another coupling member. If a tension load in excess of a given level is applied to the portable device, a reactive force from the strap acts upon the tapered surfaces, resulting in force components that release the engaged state of these protrusions and recesses. This causes the first and second coupling members to spread open, thus separating the strap therefrom.

18 Claims, 6 Drawing Sheets

STRAP ASSEMBLY

FIELD OF THE INVENTION

The present invention relates to a strap assembly for attachment to portable devices such as game units, telephones, pagers, cameras and power packs.

BACKGROUND OF THE INVENTION

Prior art for this kind of strap assembly has been disclosed in many publications, including Japanese Kokai (laid open patent applications) numbered H8-103320, H8-154725, H8-196325, H10-57121 and H10-276920.

These prior inventions added improvements in a variety of areas such as ease of manufacturing, cost of manufacturing, and ease of attachment and removal of the strap assemblies. It is important to note, however, that in all of these disclosures, as a basic requirement, special importance was placed on the reliability of the strap assembly in terms of its ability to remain securely attached to the portable item when subjected to a large pulling force.

For preventing loss of the portable unit, a strap assembly must of course maintain a given level of pull strength. However for safety reasons further increasing the pull strength of the strap assembly does not necessarily mean better quality. For instance, if the portable unit were to be inadvertently caught on nearby structures or forcefully snatched from the user in a theft attempt, it would be better to have a strap assembly that would break away from the unit when subjected to sudden unexpected external force.

Especially in strap assemblies intended for use with portables such as the popular portable game units for which there is a strong demand among the very young, greater importance should be placed on the safety of the user than on the loss of property.

SUMMARY OF THE INVENTION

In view of consideration of the safety of users of strap assemblies it is an object of the present invention to protect the user from injury in case a sudden unexpected external force is applied.

To accomplish the above and other objects, a strap assembly of the present invention is configured to separate from the portable unit when the portable unit is subjected to a tension load in excess of a given level. The present invention is suitable for application in a variety of strap assemblies. For example, a strap assembly having a belt-shaped strap that is coupled to a portable device though a coupling unit may be made such that at least the strap will separate from the portable device when the portable device is subjected to a tension load in excess of a given level.

In addition, in the configuration described above, if the assembly is constituted of a coupling for coupling a cord installed on a portable device to the strap, the coupling may comprise a coupling release means for separating the strap when the portable device is subjected to a tension load in excess of a given level.

Accordingly, when the portable device is subjected to an unexpected external force (pulling force), a strap hanging from the body of the user will be pulled away from the coupling, thus preventing the user from being restrained by external force.

Also the present invention may be configured such that the coupling comprises a first coupling member and a second coupling member that cooperate with one another to maintain a coupled state of the strap; the coupling members maintain the coupled state of the strap through the mating of a protrusion formed in one of the members with a recess formed in the other of the members. The protrusion and recess also function as a coupling release means for releasing a mated state thereof to separate the strap based on the action, on the portable device, of a tension load in excess of a given level.

When the configuration of the present invention is used, the assembly can be made so that the components are not damaged during separation. This provides an advantage in terms of economy in that the assembly can be restored to use after simply re-engaging the protrusion and recess.

The present invention may also be configured so that the strap forcefully separates from the body of the user when the portable unit is subjected to a tension load in excess of a given level. The separation from the body referred to here is not the kind of separation that occurs, for example when the strap suddenly comes off the wrist: it is a separation from the body accompanied by actual structural deformation of the strap itself, due to the portable device being subjected to a tension load in excess of a given level.

In the above configurations of the present invention, when making determinations as to the action, on the portable device, of a 'tension load in excess of a given level' it is desirable to consider a variety of factors from the standpoint of ensuring the safety of the user. These factors should include, for example, the part of the body from which the portable device is suspended, the area and width of the component of the strap assembly that is in contact with the body (e.g. the strap), and the age of the user.

As a result of experiments conducted by the inventors up to this point, wherein it was a precondition that the portable item be hung around the neck or wrist of the user's body, it was found that it was desirable in terms of ensuring the safety of user for when the portable device was subjected to a tension load of 7 kg or more (i.e., when the 'given level of tension load' was set to 7 kg or more.

DETAILED DESCRIPTION OF THE PREFERRED EMBODIMENTS

Figure 1:
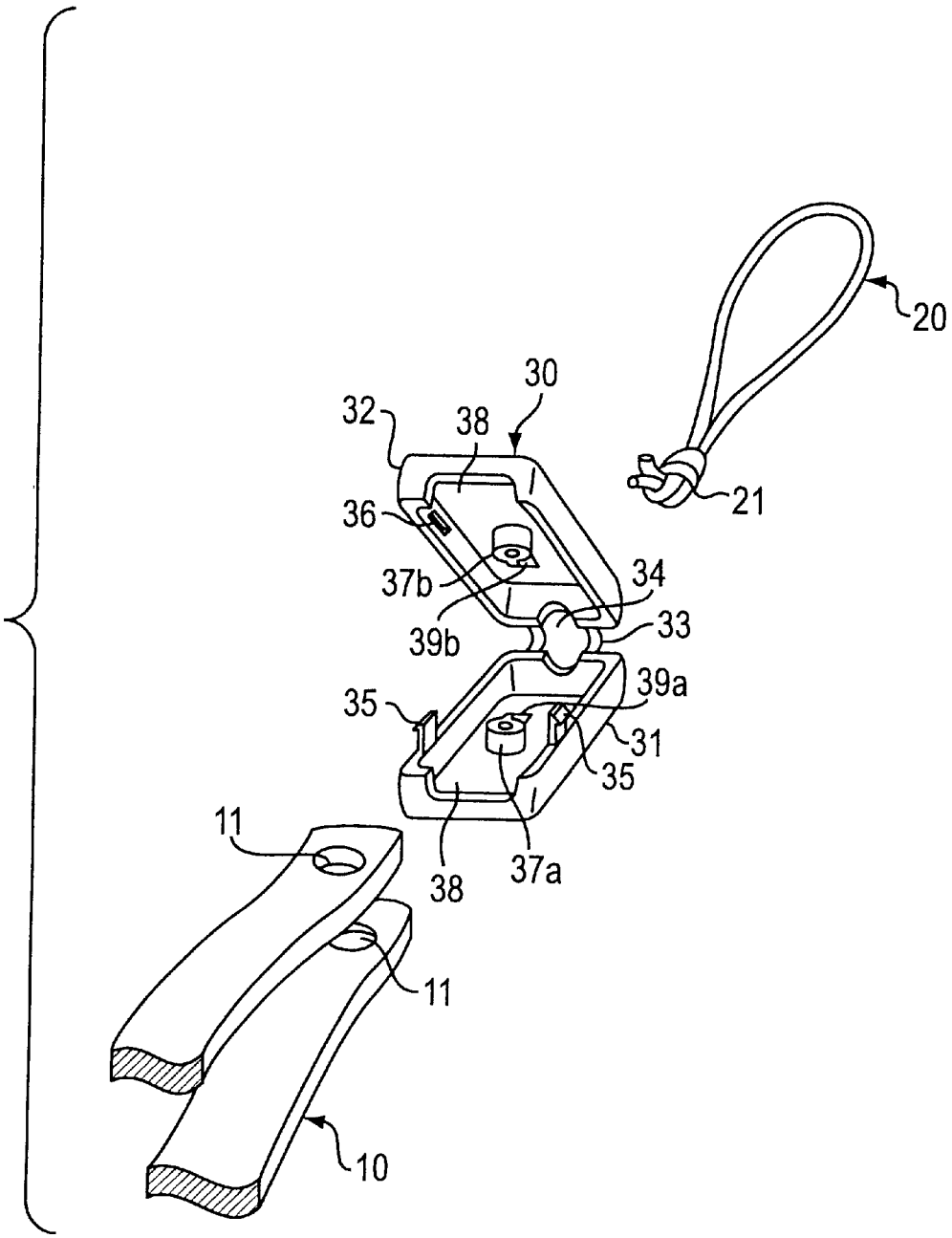
FIG. 1 is a perspective exploded view of the strap assembly according to a first embodiment of the present invention.
Figure 2:
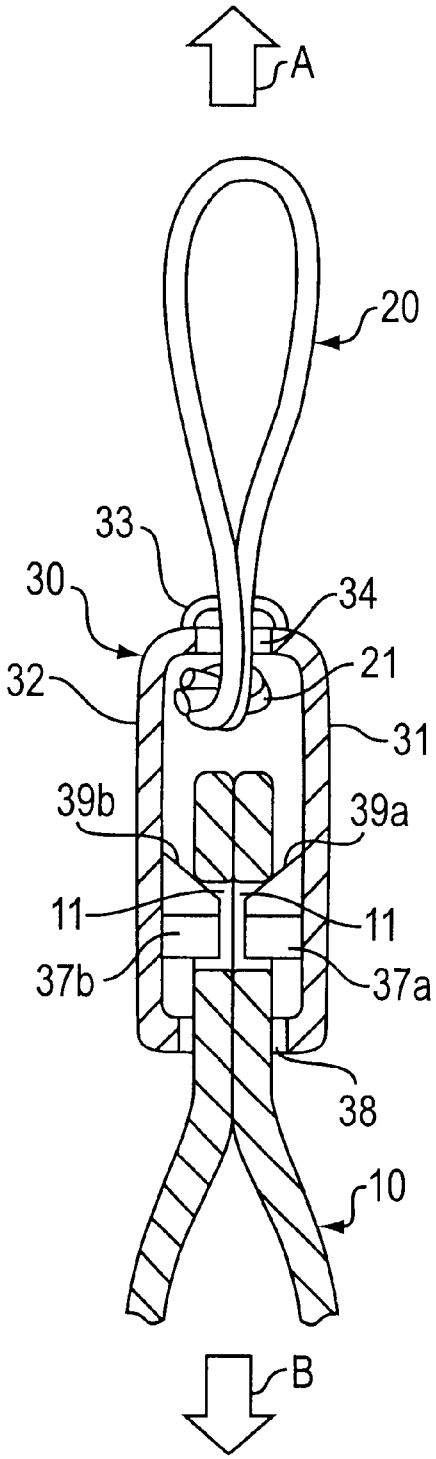
FIG. 2 is a lateral cross-sectional view to describe the operation of the strap assembly of the first embodiment of the present invention.
Figure 3:
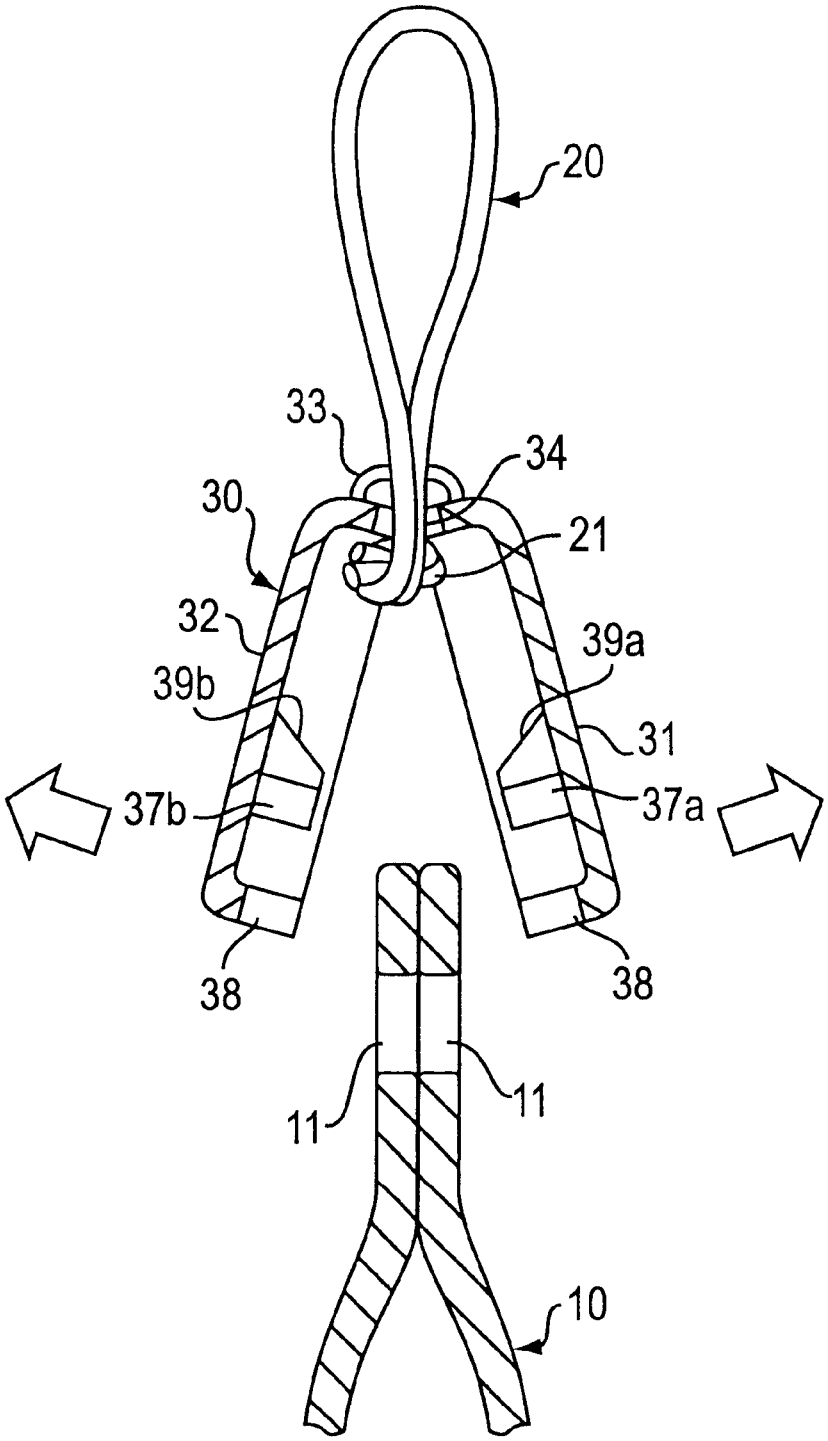
FIG. 3 is another lateral cross-sectional view, for describing the operation of the strap assembly of the first embodiment of the present invention.

Embodiments of the present invention are described in detail below, with reference to the drawings. FIGS. 1 through 3 show the configuration of a strap assembly according to a first embodiment of the present invention. This embodiment is described by an example in which the strap assembly of the present invention comprises a strap 10, a cord 20, and a coupling 30 for joining the strap and cord together.

The strap 10 is the component that hangs from the body of the user. It is formed in the shape of a belt, from a material such as vinyl, leather, or flat- or round-woven fabric. Formed in both ends of the strap 10 are coupling holes 11 for joining the strap 10 to a coupling 30. When the strap 10 is made from a relatively soft material, metal reinforcement fittings may also be provided around the edges of the coupling holes 11.

As will be described later, the coupling holes 11 in the ends of the strap 10 are attached to the coupling 30 such that the strap 10 forms a loop when presented for use. The strap 10 may be of any desired length, depending on the intended use: it might be made long, for example, when it is to be placed around the neck, or short if it is to hang from the wrist.

A cord 20 is a strap assembly component formed in the shape of a loop, for attachment to a strap installation fitting on the portable unit. The cord 20 is made of a thin but tough material having good flexibility. It could be, for example, approximately 10 cm in total length, with its ends tied together in an overhand knot 21.

As mentioned above, the coupling 30 is the strap assembly component that joins the strap 10 to the cord 20. It can be made, for example, of plastic. The coupling 30 is provided with two basket-type coupling members: a first coupling member 31 and a second coupling member 32. The base portions of these first and second coupling members 31 and 32 are connected together by a hinge 33. Formed in this hinge 33 is an installation hole 34 for attaching the cord 20. The installation hole 34 is made such that when the cord 20 is fed through it from the inside, the knot 21 will be supported at the rim of the installation hole 34.

When the first and second coupling members 31 and 32 are closed over one another such that their facing rims are superimposed, they form a cap, as shown in FIG. 2. Formed in two locations on the rim of the first coupling member 31 are two resiliently flexible pawl-shaped protrusions 35. Two recesses 36 for engaging these protrusions 35 are formed in the inner sidewalls of the second coupling member 32, in locations that correspond to those of the protrusions 35 when closed over the first coupling member 31. The first and second coupling members 31 and 32 are held together in the closed state by the mating of protrusions 35 and recesses 36.

Provided in the approximate center of the inner bottom of the first coupling member 31, is a support post 37*a*. A similar support post 37*b* is provided on the inner bottom of the second coupling member 32, in a location that corresponds to that of the support post 37*a* when closed over the first coupling member 31. When the coupling members 31 and 32 are folded together, the end surfaces of these support posts 37*a* and 37*b* come to face one another, with the two posts sharing a common center axis, as shown in FIG. 2.

Formed in each coupling member (31 and 32), in the wall opposite the installation hole 34, is a cutout 38, for passing strap 10 therethrough.

As shown in FIG. 2, strap 10 is placed such that it passes through the cutout 38, with the coupling holes 11 in its two ends aligned with one another, and positioned to fit over the support posts 37*a* and 37*b*. As the rims of the first and second coupling members 31 and 32 are closed against each other, the protrusions 35 engage the recesses 36, which brings the end surfaces of the support posts 37*a* and 37*b* adjacent to and facing one another, thus keeping them engaged with the coupling holes 11 of the strap 10.

In coupling 30 configured as described above, tapered surfaces 39*a* and 39*b* of progressively increasing width from their tips to their bases at the inner floors are formed along the cylindrical side surfaces of the support posts 37*a* and 37*b*, and more particularly, along the portions of those surfaces that face the coupling hole 11 in which the cord 20 is installed. When an attached portable unit is subjected to a tension load, these tapered surfaces 39*a* and 39*b* function to convert that load into force components directed such as to release the protrusions 35 from the recesses 36.

That is, if a tension load is applied to the portable unit (acting in the direction of the arrow A in FIG. 2) that tension load, transmitted by the cord 20 and the first and second coupling members 31 and 32, will act on the strap 10 in contact with the tapered surfaces 39*a* and 39*b* of the support posts. A reactive force against the tension load from the strap 10 will then act upon the support post tapered surfaces 39*a* and 39*b* in the direction of the arrow B in FIG. 2. This reactive force will be converted to force components in a direction perpendicular to the tapered surfaces 39*a* and 39*b*, thus urging the first and second coupling members 31 and 32 to spread apart.

When the force acting to urge the first and second coupling members 31 and 32 apart becomes greater than the force keeping the protrusions 35 engaged with the recesses 36, the protrusions 35 will bend and disengage. As a result, the coupling members 31 and 32 will spread apart as shown in FIG. 3, pulling the support posts 37*a* and 37*b* out of the coupling holes 11 of the strap 10. In this manner, the strap 10 will be separated from the coupling 30, thus preventing the user from being restrained by external force.

The determination as to how much tension load acting upon the portable unit will cause the coupling to disengage is made from the standpoint of what is required to ensure the safety of the user. This level can be adjusted, for example, by changing the angle of the tapered surfaces 39*a* and 39*b*, changing the shape or dimensions of the protrusion 35, or changing the material of which the coupling members 31 and 32 are made. It is preferred, however, to adjust for a level of pull strength that will allow the coupling to disengage without damaging the protrusions 35 or other components of the coupling.

Strap 10 that has been separated from the coupling 30 by the action of an excessive tension load can be reinstalled in the coupling 30 by reinserting the support posts 37*a* and 37*b* in the coupling holes 11 and engaging the protrusions 35 with the recesses 36. This provides an advantage in terms of economy in that even if the strap 10 becomes separated it can easily be restored to its coupled state, thus avoiding the need to purchase a replacement strap assembly.

Next, the strap assembly in a second embodiment of the invention will be described, with reference to FIGS. 4 and 5. In these figures, items that are the same as those of the first mode, described above, retain the same reference numbers as in the earlier drawings.

In this embodiment of the invention, a coupling 40, for coupling strap 10 to cord 20, comprises a cap-shaped first coupling member 41, and a second coupling member 42 insertable into the first coupling member 41.

Formed in the base of the first coupling member 41 is an installation hole (not shown) for installing the cord 20. This installation hole 41 is made such that when the cord 20 is fed through it from the inside, a knot 21 (see item 21 of FIG. 1) will be supported at the rim of the installation hole.

Formed facing each other on opposite inner walls of the first coupling member 41 are two recesses 43.

Figure 5:
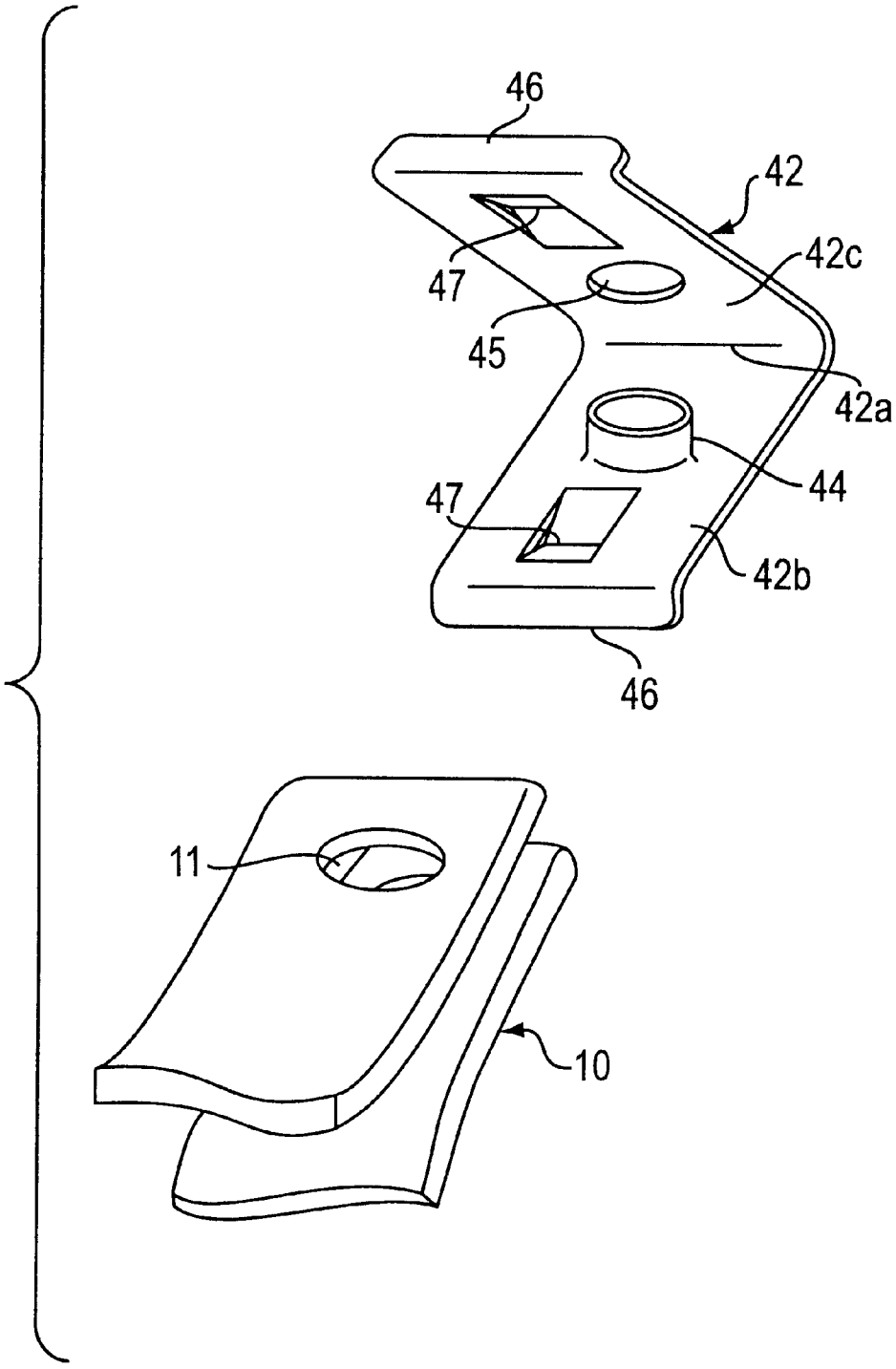
FIG. 5 is an enlarged exploded view of the ends of the strap and a second coupling member that constitute the strap assembly of the second embodiment of the present invention.

The second coupling member 42 is formed from a sheet material such that it can be folded in the middle, as shown in FIG. 5. In this second coupling member 42, a support post 44 is formed in the approximate center of a side 42*b*, which is one of two symmetrical sides having a bend portion 42*a* as the dividing line therebetween. Formed in the other side 42*c* is a through-hole 45 into which the end of the support post 44 will fit when the member is folded.

The coupling holes 11 in the two ends of the strap 10 are placed in alignment with one another and fitted over the support post 44. Next, the second coupling member 42 is folded in the middle and attached to the ends of the strap 10 as shown in FIG. 4. 10 The second coupling member 42, attached to the ends of the strap 10, is then inserted into the first coupling member 41 through its opening 41*a*. A bent portion 46 and 46 is provided at each end of the second coupling member 42. The bent portions 46 and 46 make contact with the first coupling member 41 at the rim of its opening 41*a*, thus regulating the amount of insertion of the second coupling member 42.

A protrusion 47 is formed on each side (42*b* and 42*c*) of the second coupling member 42 in a location that will correspond to that of a recess 43 inserted in the first coupling member 41. The function of these protrusions 47 is to mate with the recesses 43, to thereby connect the second coupling member 42 to the first coupling member 41.

In this manner, the cord 20 and strap 10 are joined through the connection of the first and second coupling members 41 and 42.

The releasing of mated state protrusion 47/recess 43 is adjusted to occur when the portable device is subjected to a tension load in excess of a given level. This adjustment can be effected, for example, by changing the shape and/or dimensions of the protrusions 47 and recesses 43, or the material or thickness of the first coupling member 41. Also, in this mode of the invention, the protrusions 47 can be disengaged from the recesses 43 by effecting a slight deformation of the first coupling member 41. It is therefore preferred that the first coupling member 41 be formed from a plastic having shape deformation elasticity.

When the tension load acting on the portable unit exceeds a certain level, the protrusions 47 disengage from the recesses 43, causing the strap 10 to be separated from the first coupling member 41 along with the second coupling member 42, thus preventing the user from being restrained by external force.

In this mode as well, then, the determination as to how much tension load acting upon the portable unit will cause the protrusions 47 to disengage from the recesses 43, is made from the standpoint of what is required to ensure the safety of the user's person.

A second coupling member 42 that has been separated from a first coupling member 41 due to an excessive tension load can be reinserted into the first coupling member 41 through its opening 41*a* to reengage the protrusions 47 with the recesses 43 and thereby restore the connected state. This is economical in that it avoids the need to purchase a replacement.

Figure 6:
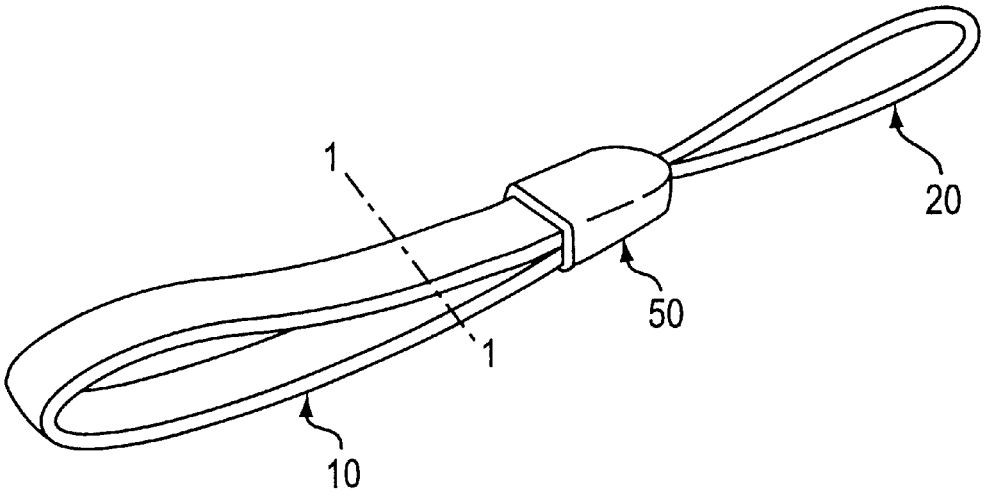
FIG. 6 is a perspective view showing a variation of the present invention.

The present invention, however, is not limited to the embodiments described above. For example, in a strap assembly as shown in FIG. 6 comprising cord 20, coupling 50, and strap 10, the strength could be made such that the cord 20 or strap 10 will break when an attached portable unit is acted upon by a tension load in excess of a given level. The pull strength of the cord 20 or strap 10 can be adjusted by changing the material of which they are made, or the dimensions of their cross-sections. In addition, it is also possible to form a notch in an appropriate location on the strap 10 or cord 20, and make adjustments such that when the assembly is subjected to a tension load in excess of a given level, a large concentration of stress will occur in the notched portion.

When the cord 20 breaks, strap 10 is separated from the portable unit. If it is the strap 10 that breaks, the strap 10 separates from the body of the user. In either case the user is prevented from being restrained by external force.

Also, when the invention is configured to have a coupler 40 with an installation hole 34, the same as that of the first embodiment (as shown in FIG. 1), with the cord 20 fed through this installation hole 34 from the inside such that a knot 21 of the cord 20 is supported by the rim of the hole 34, the cord 20 can be made of a high elasticity material such as rubber and formed such that when the portable unit is subjected to a tension load in excess of a given level, the knot 21 of the cord 20 will be compressed and deformed sufficiently to slip through the installation hole 34, thus separating strap 10 from the portable unit.

Figure 4:
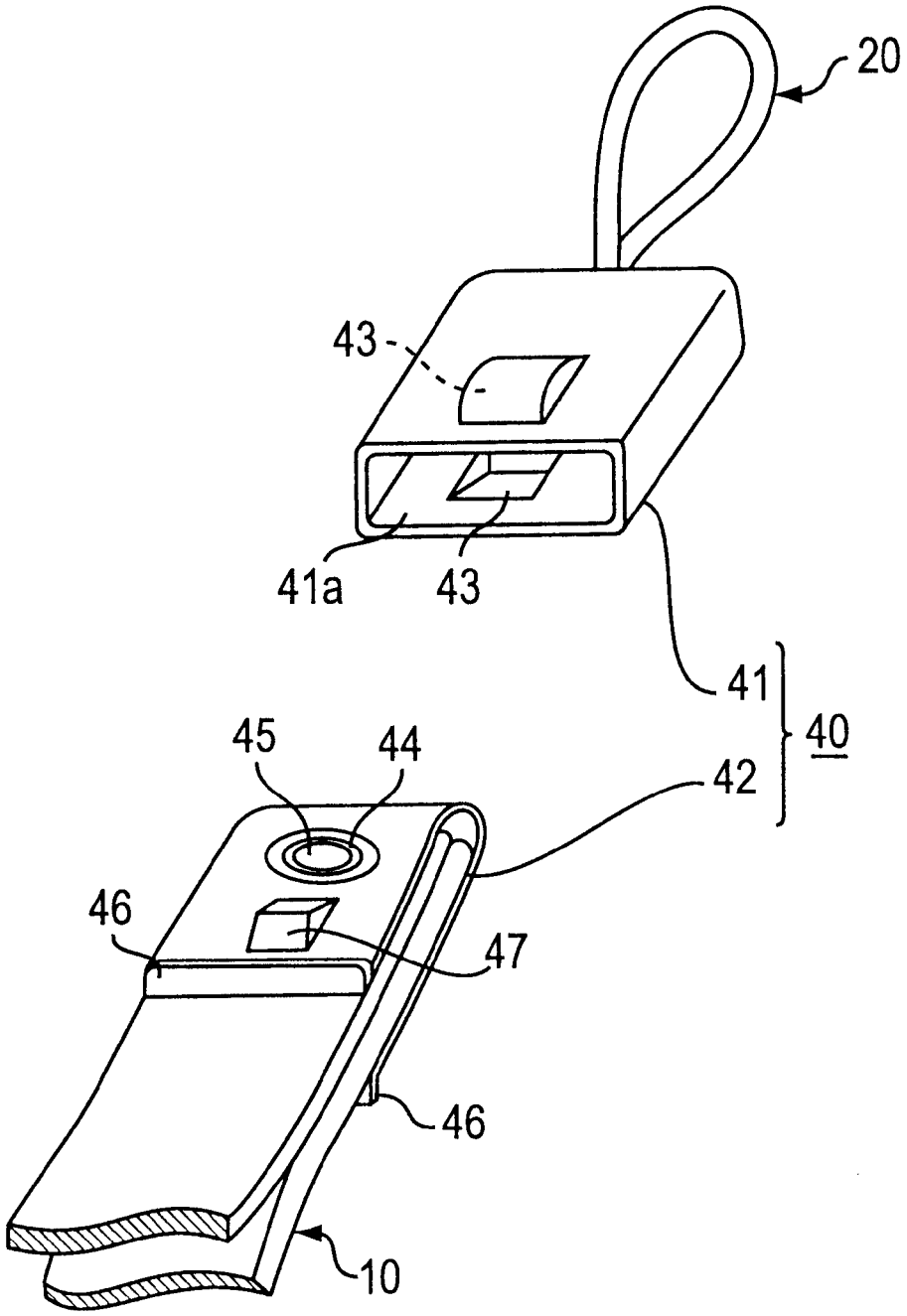
FIG. 4 is a perspective exploded view of the strap assembly of a second embodiment of the present invention.

In another possible configuration, strap 10 could be cut at its middle portion (e.g., the portion indicated by the line I—I in FIG. 6) and the loose ends reconnected by a component equivalent to the coupler 40 shown in FIG. 4. This component would then function to break the strap 10 at the line I—I, thus separating it from the body of the user when subjected to a tension load in excess of a given level.

Thus as described above, because the present invention is configured to separate from either the portable unit or the user if the portable unit is subjected to a tension load in excess of a given level, it is capable of protecting the user from injury during the application of sudden unexpected external force.

What is claimed is:

1. A strap assembly for carrying a portable device comprising:

a belt-shaped strap coupled to a portable device through a coupling means, said coupling means being configured such that at least said belt-shaped strap will separate from said portable device when said portable device is subjected to a tension load in excess of a given level, wherein said coupling means includes a coupling for coupling a cord installed on said portable device to said belt-shaped strap, and a coupling release means for separating said strap from said portable device when said portable device is subjected to a tension load in excess of a given level.

2. The strap assembly according to claim 1, wherein:

said coupling comprises a first coupling member and a second coupling member that cooperate with one another to maintain a coupled state of said strap;

said first and second coupling members have one of a protrusion and a recess and maintain said coupled state of said strap through a mating of the protrusion formed in one of first and second said coupling members with the recess formed in the other of said first and second coupling members; and said protrusion and recess include said coupling release means for releasing a mated state thereof to separate said strap based on an action, on said portable device, of a tension load in excess of a given level.

3. The strap assembly according to claim 1, wherein said coupling comprises a first coupling member and a second coupling member that cooperate with and mate with one another to maintain a coupled state of said strap;

coupling holes formed in both ends of said strap;

support posts formed in said first and second coupling members for extension through said coupling holes, and wherein end surfaces of said support posts are brought near or in contact with one another as said first and second coupling members are engaged together to form a mated state,;

said support posts have cylindrical side surfaces; and wherein said coupling release means further comprise tapered surfaces formed along said cylindrical side surfaces of said support posts for converting a tension load in excess of a given level acting on said portable device into force components in directions such as to effect release of the mated state of said first and second coupling members.

4. The strap assembly according to claim 2, wherein:

said first coupling member is formed in the shape of a cap, and said cord is installed in said first coupling member;

said second coupling member is shaped to be insertable into said first coupling member, and both ends of said strap are supported in said second coupling member; and said recess is formed in an interior side surface of said first coupling member and said protrusion is formed on an exterior side surface of said second coupling member.

5. A strap assembly according to claim 1, wherein said given level of tension load is at least 7 kg.

6. The strap assembly according to claim 2, wherein said given level of tension load is at least 7 kg.

7. The strap assembly according to claim 3, wherein said given level of tension load is at least 7 kg.

8. The strap assembly according to claim 4, wherein said given level of tension load is at least 7 kg.

9. The strap assembly according to claim 2, wherein said protrusion and recess are provided with tapered surfaces that cause said first and second coupling members to separate and release said mated state.

10. A strap assembly for attachment to a device comprising:

a cord attached to a device, and a strap removably coupled to said cord through a coupling means, said coupling means further comprising coupling release means for separating said strap from said device when said device is subjected to a tension load in excess of a given level.

11. The strap assembly according to claim 10, wherein said given level of tension load is at least 7 kg.

12. A strap assembly for attachment to a portable device comprising:

a cord attached to a portable device;

a strap removably coupled to said cord through a coupling;

said coupling further comprising a first coupling member and a second coupling member that removably engage with one another to maintain said strap coupled to said cord, and coupling release means for disengaging said first and second coupling members when said portable device is subjected to a tension load in excess of a given level.

13. A strap assembly in accordance with claim 12, wherein said first and second coupling members spreadingly disengage from one another when said portable device is subjected to a tension load in excess of a given level.

14. A strap assembly in accordance with claim 13, further comprising:

coupling holes formed in both ends of said strap;

support posts having side surfaces formed in said first and second coupling members for extension through said coupling holes, and wherein end surfaces of said support posts are brought near or in contact with one another as said first and second coupling members are engaged together to form a mated state; and wherein said coupling release means further comprise tapered surfaces formed along said support posts for converting a tension load in excess of a given level acting on said portable device into force components in directions such as to effect release of the mated state of said first and second coupling members.

15. A strap assembly in accordance with claim 14, wherein said tapered surfaces are formed on said side surfaces of said support posts.

16. A strap assembly for attachment to a portable device comprising:

a cord attached to a portable device;

a strap removably coupled to said cord through a coupling;

said coupling further comprising a first coupling member and a second coupling member insertable into said first coupling member to form a mated state between said first and second coupling members; and coupling release means for forcing said second coupling member from said first coupling member when said portable device is subjected to a tension load in excess of a given level.

17. A strap assembly in accordance with claim 16, wherein said first coupling member has a recess and said second coupling member has a protrusion and said coupled state of said strap is maintained through the engagement of said recess with said protrusion; and said protrusion and recess further comprise said coupling release means for releasing said mated state thereof to separate said strap based on an action, on said portable device, of a tension load in excess of a given level.

18. The strap assembly according to claim 17, wherein said protrusion and recess are provided with tapered surfaces that cause said first and second coupling members to separate and release said mated state.

* * * * *